US005285210A

United States Patent [19]

Sato et al.

[11] Patent Number: 5,285,210

[45] Date of Patent: Feb. 8, 1994

[54] DOUBLE LOOP ANTENNA WITH REACTANCE ELEMENTS

[75] Inventors: Gentei Sato, Urawa; Haruo Kawakami, Yokohama, both of Japan

[73] Assignee: Nippon Sheet Glass Co., Ltd., Osaka, Japan

[21] Appl. No.: 966,593

[22] Filed: Oct. 26, 1992

Related U.S. Application Data

[63] Continuation of Ser. No. 694,472, May 1, 1991, abandoned.

[30] Foreign Application Priority Data

May 8, 1990 [JP] Japan ..... 2-117918

[51] Int. Cl.[5] ..... H01Q 1/32; H01Q 1/38

[52] U.S. Cl. ..... 343/713; 343/744

[58] Field of Search ..... 343/713, 741, 742, 744, 343/806, 846, 848; H01Q 1/34, 1/38, 1/12

[56] References Cited

U.S. PATENT DOCUMENTS

| | | | |
|---|---|---|---|
| 1,910,147 | 5/1933 | Bruce | 343/806 |
| 2,533,529 | 12/1950 | Spindler | 343/806 |
| 3,623,110 | 11/1971 | Doi et al. | 343/744 |
| 3,766,563 | 10/1973 | Sauer et al. | 343/713 |
| 4,527,164 | 7/1985 | Cestaro et al. | 343/713 |
| 4,872,022 | 10/1989 | Schock | 343/891 |

*Primary Examiner*—Michael C. Wimer

*Attorney, Agent, or Firm*—Woodcock Washburn Kurtz Mackiewicz & Norris

[57] ABSTRACT

A double loop antenna which is suitable for a window antenna of a motor vehicle. Two contiguous loop conductors are formed on an insulation plane such as a window glass of the vehicle. A power feed point is provided at a contact portion of the loops. A reactance element conductor is coupled to each of said loop conductors, so that antenna impedance at the feed point becomes the only resistance component. The antenna has good transmission/reception characteristics in a UHF band for use of a vehicle telephone.

7 Claims, 7 Drawing Sheets

DOUBLE LOOP ANTENNA WITH REACTANCE ELEMENTS

This is a continuation of application Ser. No. 694,472, filed May 1, 1991, abandoned.

BACKGROUND OF THE INVENTION

1. Field of the Invention

This invention relates to a double loop antenna, and more particularly, to an antenna printed on a dielectric substance such as a window glass of a motor vehicle for a use to a mobile telephone.

2. Description of the Prior Art

A double loop antenna attached on a glass window of a motor vehicle for use in a UHF band is known. The double loop antenna comprises a pair of semiloop antenna elements with half-wavelength conductors branched from a power feed point in both lateral directions along a grounded conductor, their end terminals are grounded and the feed point is unbalanced power fed (Japanese patent laid open application No. 69704/1987 and U.S. Pat. No. 4,721,964).

FIG. 11 shows a prior art of the double loop antenna which is printed on a rear window glass of a motor vehicle.

In FIG. 11, numeral 1 shows a transmission/reception antenna for an automobile telephone, elements of which are printed on a rear window glass 2 together with defogging heater wires 3 and an antenna conductor 4 for radio (FM/AM) reception. The transmission/reception antenna 1 is arranged along a body of the automobile and consists of a pair of semiloop elements 1*a* and 1*b* branched laterally from a power feed point 12*a*. Both end terminals 1*c* and 1*d* of the elements 1*a* and 1*b* are grounded so that the feed point 12*a* is unbalanced power fed from a core conductor of a coaxial feeder cable 7.

This transmission/reception antenna 1 has a sufficient gain and an almost non-directional directivity in a UHF band ranging 850–950 MHz.

The transmission/reception antenna 1 has small dips in directivity for waves coming from sides of the automobile and a defect that gain is slightly lower than a dipole antenna.

OBJECT AND SUMMARY OF THE INVENTION

It is an object of this invention to improve these problems and improve directivity and gain of the loop antenna.

According to this invention, there is provided a double loop antenna comprising two contiguous loop conductors, power feed point means arranged at a contact portion of the loops, and a reactance element conductor coupled to each of the loop conductors.

Impedance at the feed point becomes only resistance component by loading effect of the reactance element. Matching loss between the antenna and the feeder cable is reduced to increase gain. Phase shift between reception waves on the loops is reduced so that dips in directivity appearing in the direction of arrangement of the loops is compensated to make non-directional characteristic.

DETAILED DESCRIPTION OF A PREFERRED EMBODIMENT

Figure 1:
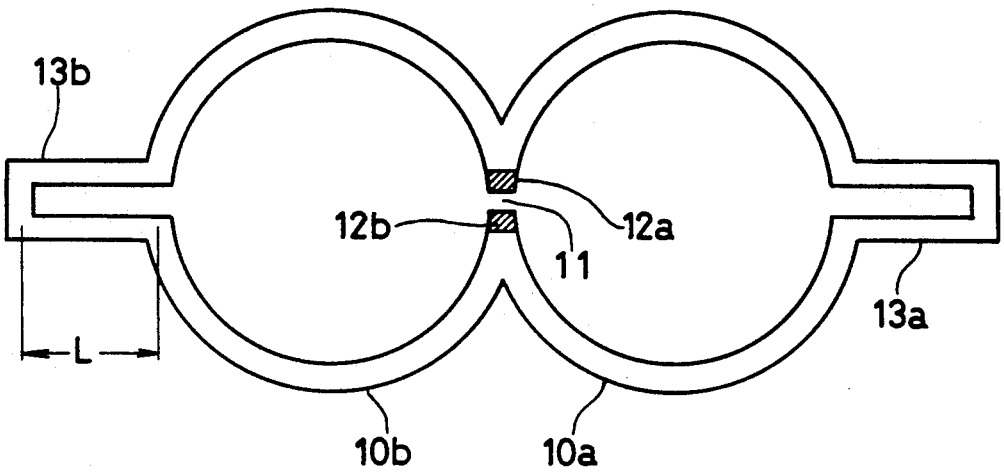
FIG. 1 is an illustration of a conductor pattern showing an embodiment of a double loop antenna according to this invention.

FIG. 1 shows a conductor pattern of a double loop antenna according to this invention. This conductive pattern may be formed by printing a conductive material on a surface of a dielectric plate or by arranging conductive wires in a dielectric body. The loop antenna consists of two contiguous general circular loop conductors 10*a* and 10*b* each provided on a window glass of a vehicle or automobile. For example, the first general loop 10*a* consists of separated two semicircular conductors 21 and 22 each having first and second ends 211 and 212 (or 221 and 222). The second general loop 10*b* consists of separated two semicircular conductors 23 and 24 each having third and fourth ends 233 and 234 (or 243 and 244). A pair of feed terminal portions 12*a* and 12*b* are provided at interconnecting portion of the loops with a gap 11 of about 2 mm provided to space the terminals. The first and second ends 211 and 233, and 221 and 243 are therefore coupled to provide the feed terminal portions 12*a* and 12*b* respectively. One (12*a*, for example) of the terminal portions 12*a* and 12*b* is fed with a signal and the other is grounded. Reactance element conductors 13*a* and 13*b* are formed in respective loop conductors 10*a* and 10*b* with intervals by 180 deg. apart from the terminal portions 12*a* and 12*b*. The first reactance element conductor 13*a* is therefore connected to the second ends 212 and 222 of the semicircular conductors 21 and 22. The second reactance element conductor 13*b* is connected to the fourth ends 234 and 244 of the semicircular conductors 23 and 24. The reactance element conductors are also provided on the window glass. Each of the reactance conductors 13*a* and 13*b* is formed into a U-shape by projecting a part of respective loop conductors 10*a* and 10*b* in a radial direction. The reactance conductors 13*a* and 13*b* cancel a reactance component included in an impedance of the antenna measured at the terminal 12*a* and 12*b* to result in almost only resistance component.

The antenna 1 in FIG. 1 is provided with a radius for each of loop conductors 10*a* and 10*b* so as to operate as a one-wavelength double loop antenna in a range of 800–900 MHz. Providing 900 MHz for a designing frequency, one-wavelength corresponds to 333.3 mm. The wavelength is shortened due to dielectric constant $\epsilon_r$ of the dielectric substance on which the antenna conductor is attached. When a glass ($\epsilon_r$=3.0) is employed as dielectric substance, shortening ratio is:

$$\eta = \frac{1}{\sqrt{\epsilon_r}} = 0.58.$$

The shortened wavelength is:

$$\lambda' = 333.3 \times 0.58 = 192.5 \text{ (mm)}.$$

Therefore, the radius of the loop conductors 10*a* and 10*b* is:

$$R = 192.5/2\pi = 30.6 \text{ (mm)}.$$

In this embodiment, a conductor width is as large as 4.0 mm.

Figure 2:
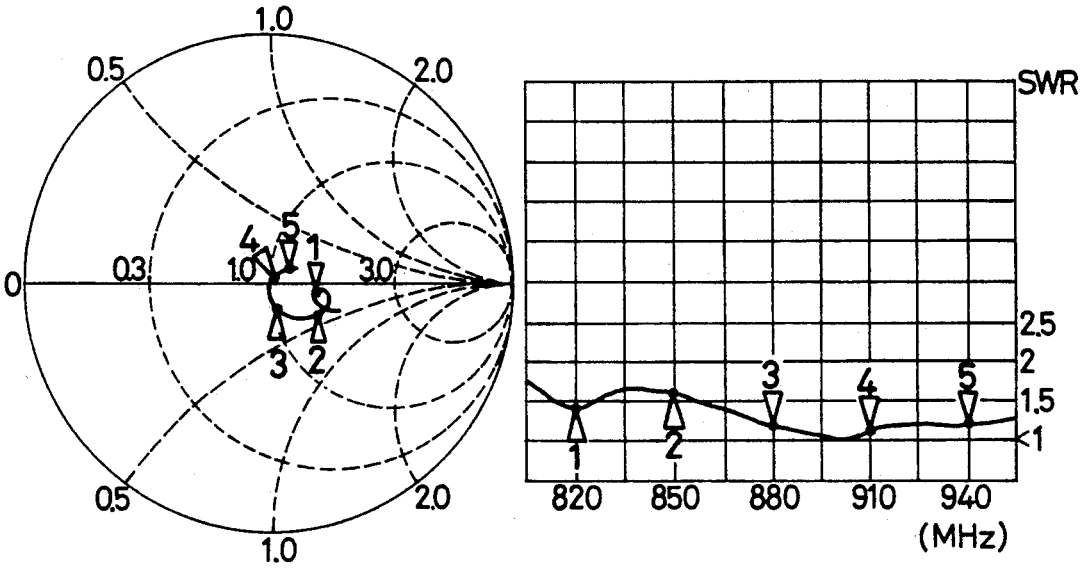
FIG. 2 is a Smith chart and SWR diagram for illustration of an impedance characteristic of the antenna in FIG. 1.

Sizes of the reactance conductors 13*a* and 13*b* are determined so that the U-shaped channel form having a width of 9.6 mm and depth L minimizes a reactance component measured at the terminals 12*a* and 12*b*. FIG. 2 shows a Smith chart and an SWR graph for illustration of an impedance characteristic when L is fixed at 25 mm.

Figure 3:
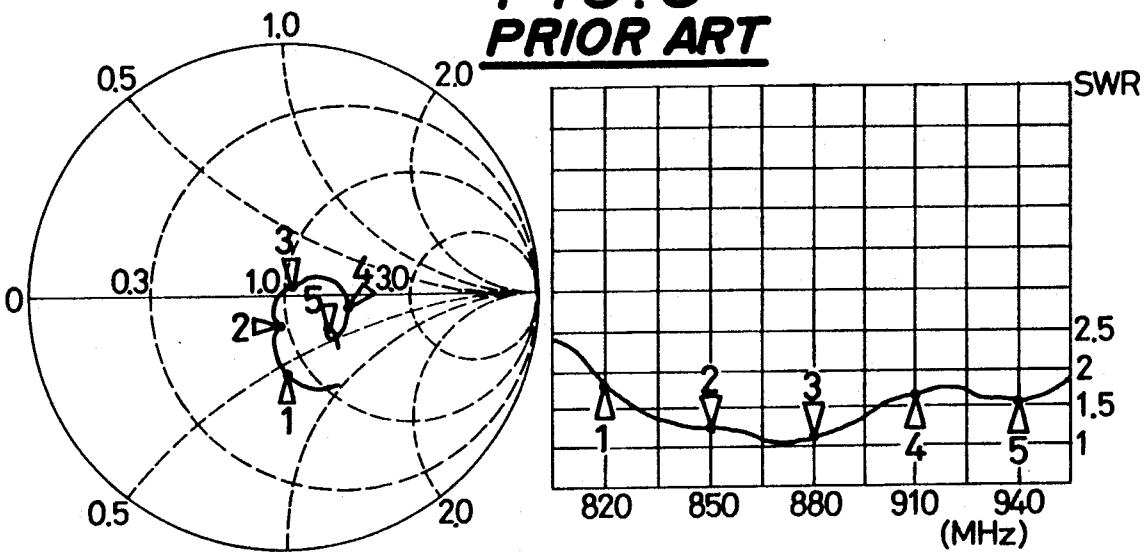
FIG. 3 PRIOR ART
FIG. 3 is a chart for illustration of an impedance characteristic of a prior art double loop antenna for comparison with FIG. 2.

FIG. 3 shows as a reference a Smith chart and a SWR graph for a prior art antenna pattern having no reactance element conductors 12*a* and 12*b*.

It is shown by comparison between FIGS. 2 and 3 that an antenna impedance near to the characteristic impedance $Z_0 = 50\Omega$ (normalized impedance $Z/Z_0 = 1.0$) is obtained in a band of 820–940 MHz by means of additional reactance element conductors 13*a* and 13*b*. In a reception band of 850–910 MHz and a transmission band of 910–940 MHz for mobile telephone, the present SWR is less than 1.5, resulting in good matching with the feeder cable in comparison with the prior art (FIG. 3).

Figure 4:
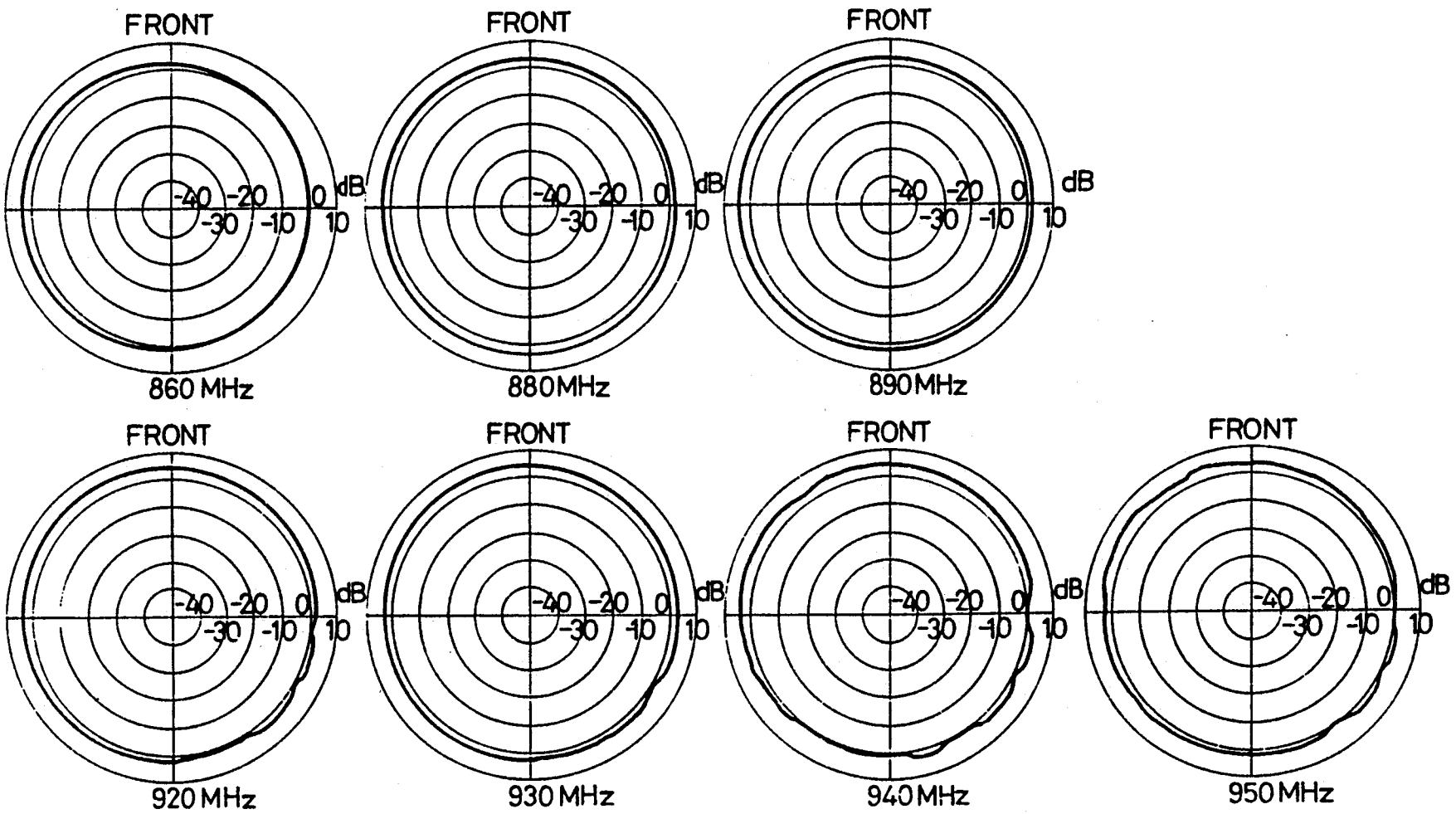
FIG. 4 is a chart showing a directivity of the antenna of FIG. 1.
Figure 5:
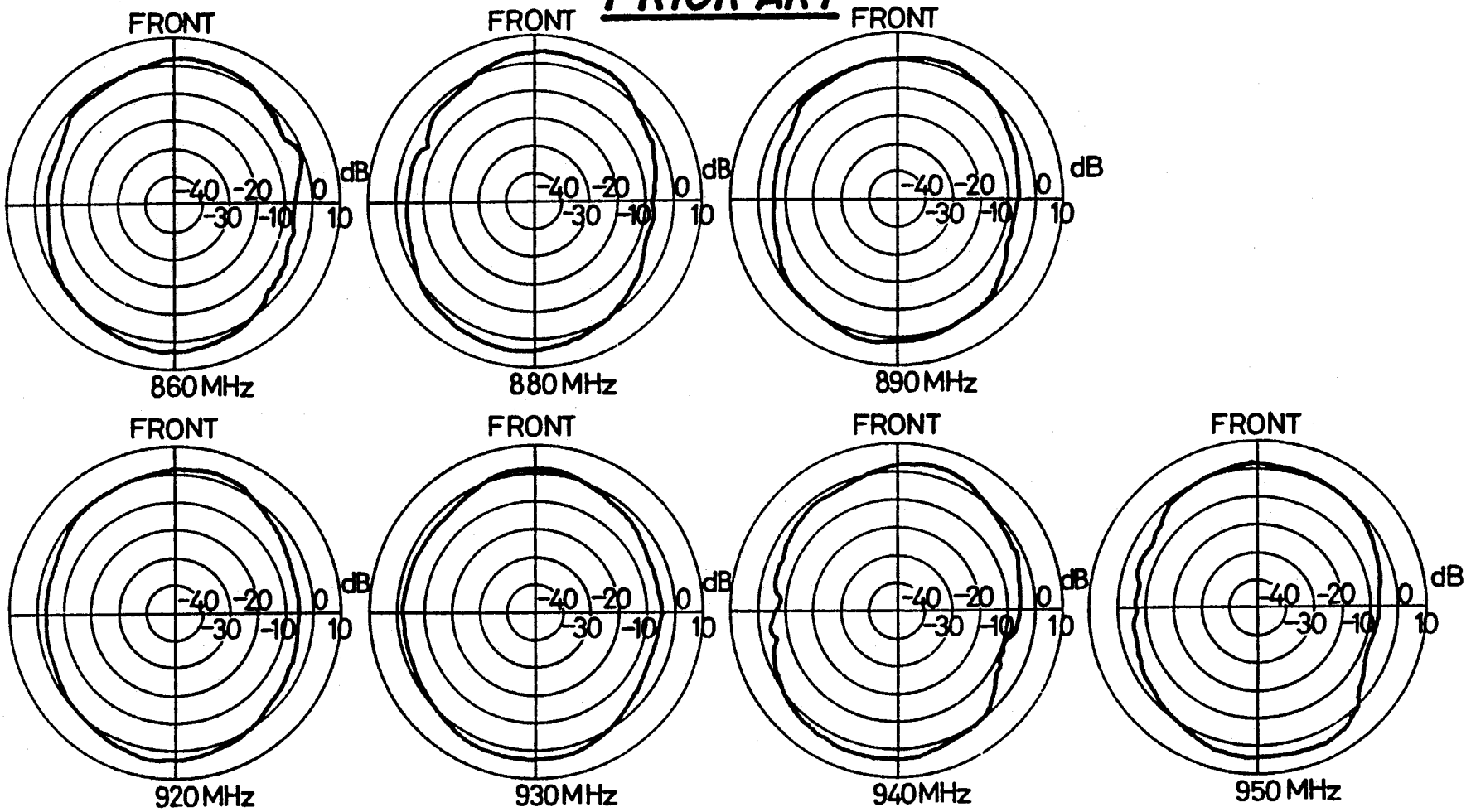
FIG. 5 PRIOR ART
FIG. 5 is a chart showing a directivity of the prior art double loop antenna.

FIG. 4 shows a directivity of the antenna conductor in FIG. 1. FIG. 5 shows a directivity of a prior art antenna conductor having no reactance element conductors 13*a* and 13*b*. It appears by comparison between FIGS. 4 and 5 that gain of the antenna in the embodiment is improved for waves coming from both sides normal to a traveling direction. In FIGS. 4 and 5, a base of 0 dB in gain corresponds to a dipole antenna and measurement is performed with a vertically polarized wave.

Figure 6:
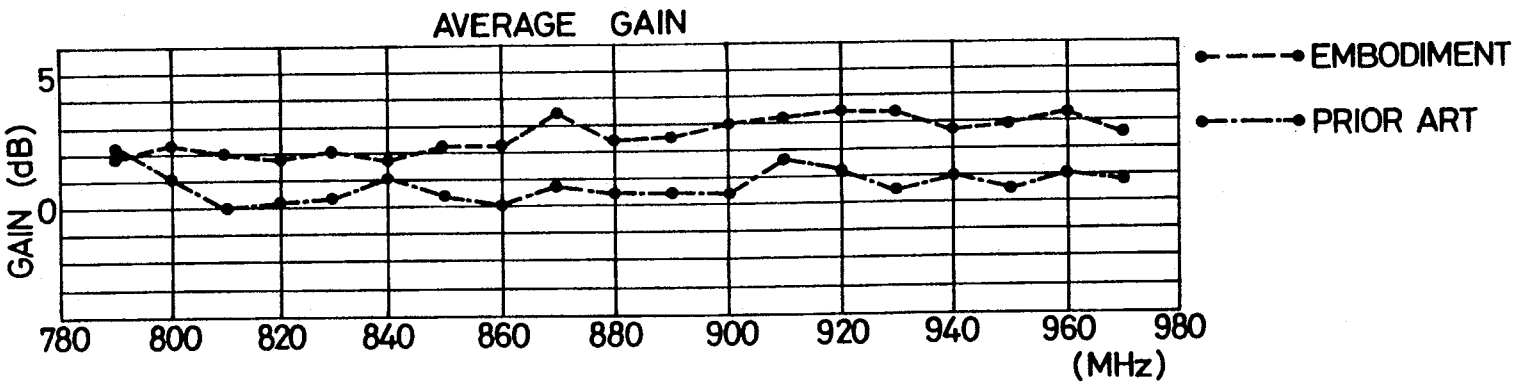
FIG. 6 is a chart showing gain-frequency characteristics of the antenna in FIG. 1 and the prior art antenna.

FIG. 6 shows a frequency characteristic (doted line) of average gain along a horizontal plane (0–360 deg.) for the antenna in the embodiment and a frequency characteristic (dashed line) for a prior art antenna pattern having no reactance element conductors 13*a* and 13*b*. As shown by the graph, the antenna pattern in the embodiment has an improved average gain by about 2 dB larger than the prior art in a band of 800–960 MHz. In FIG. 6, a base of 0 dB in gain corresponds to a dipole antenna and measurement is performed with a vertically polarized wave.

Gain and directivity of the double loop antenna in the embodiment are improved as shown in FIGS. 2, 4 and 6, due to the fact that matching to a feeder cable is improved to reduce a matching loss and a phase shift between reception waves on respective loops is reduced.

Figure 7:
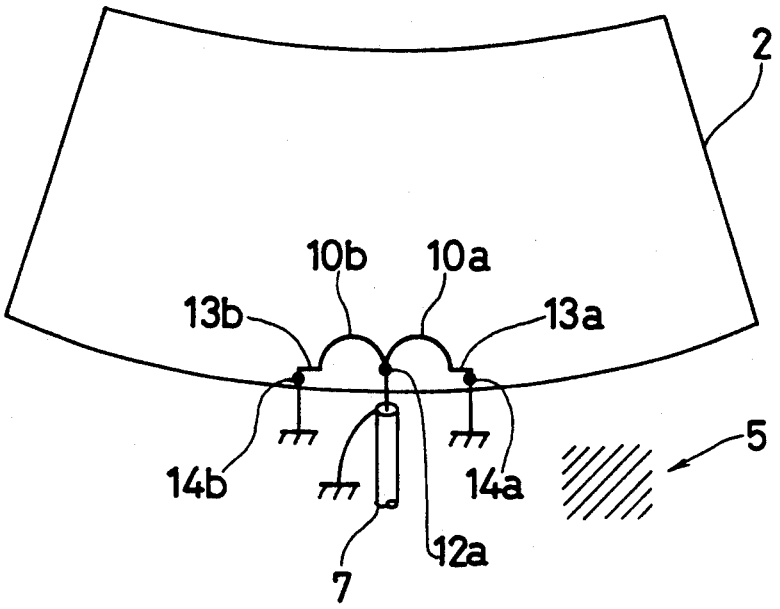
FIGS. 7–10, are illustration showing conductors on a window glass of an automobile according to modifications of mirror image antenna.
Figure 11:
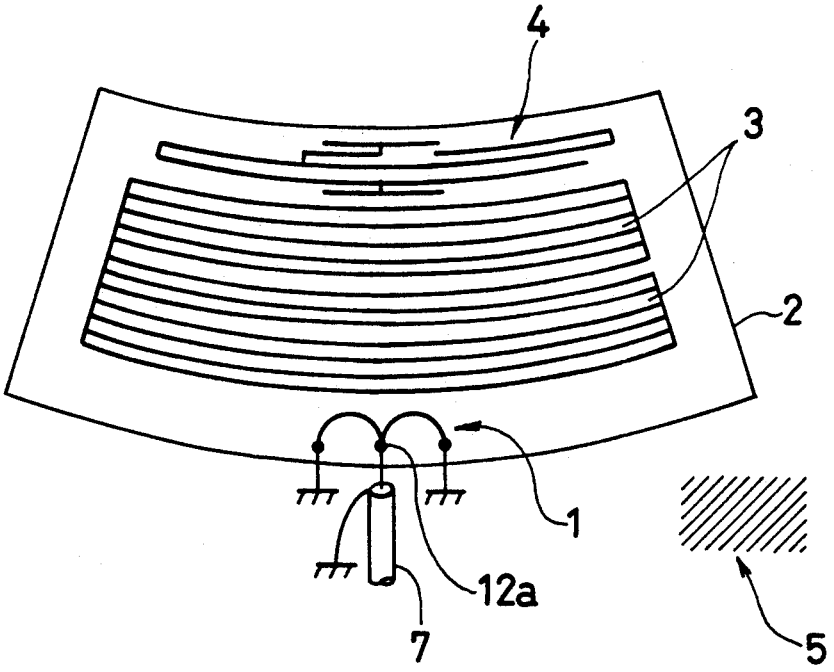
FIG. 11 PRIOR ART
FIG. 11 is an illustration of conductor pattern on a prior art window glass antenna for the automobile.

In the double loop antenna shown in FIG. 1, an upper half and a lower half of the conductor are symmetrical to each other, so that a mirror image antenna may be formed with employing one of halves. For this modification, as shown in FIG. 7, semiloop conductors 10*a* and 10*b* and L-shaped reactance element conductors 13*a* and 13*b* corresponding to the upper half of the antenna of FIG. 1 are arranged on the glass 2 close along the body 5 which is a grounded conductor. Terminals 14*a* and 14*b* are provided at both ends of the reactance element conductors 13*a* and 13*b* for grounding the conductors. A core conductor of a coaxial feeder cable 7 is connected to a power feed terminal portion 12*a* formed at a junction point of the semiloop conductors 10*a* and 10*b*. Moreover in the embodiment of FIG. 7, heater wires 3 and an antenna conductor 4 for radio reception may be provided on the glass 2 in a similar way as the prior art in FIG. 11.

Figure 8:
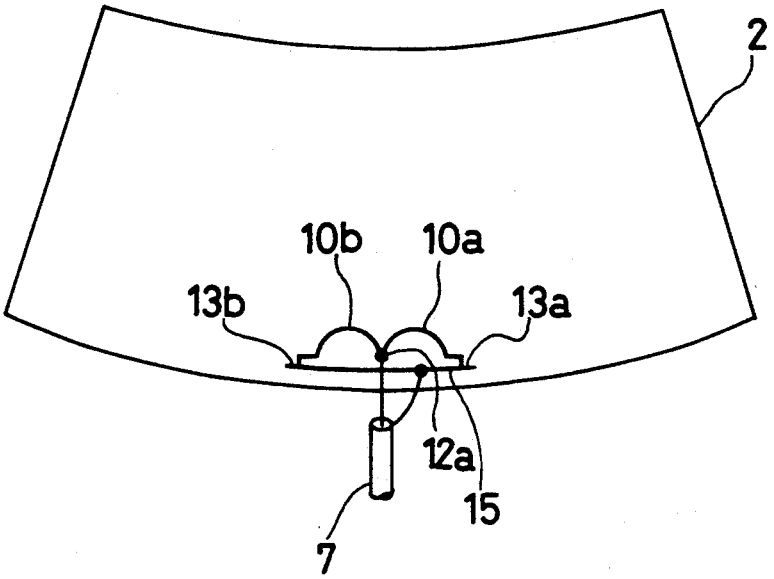

As shown in FIG. 8, a ground line conductor 15 may be printed on the glass together with the semiloop conductors 10*a* and 10*b* and L-shaped reactance element conductors 13*a* and 13*b*. Both ends of the L-shaped reactance element conductors 13*a* and 13*b* are connected to the ground line 15. An outer conductor (grounded) of the feeder cable 7 is connected to the line 15.

Figure 9:
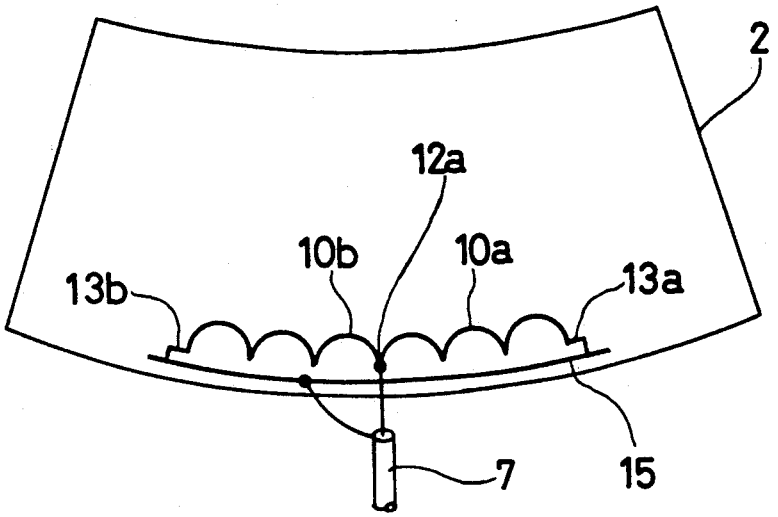
Figure 10:
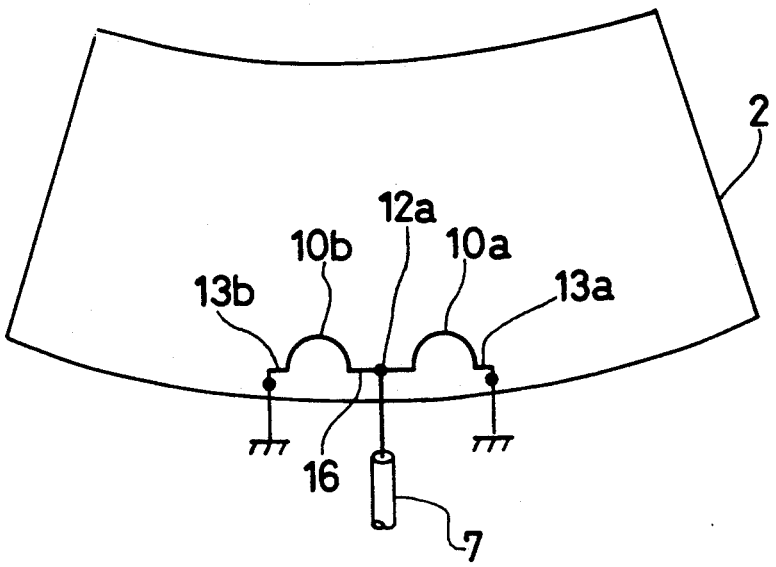

As shown in FIG. 9, a plurality of juxtaposed semiloop conductors 10*a* and 10*b* may be linked with L-shaped reactance element conductors 13*a* and 13*b* attached to the ends of the semiloops. As shown in FIG. 10, a line conductor 16 may be inserted between the semiloop conductors 10*a* and 10*b* to be spaced laterally. Length of the line conductor 16 may be ½ of a wavelength.

Polygon may be employed for the loop conductors 10*a* and 10*b* in stead of a circle or a half circle.

According to this invention, a reactance element conductor is provided to each of loop conductors consisting a double loop antenna to reduce its imaginary or reactance component of the antenna impedance to only its resistance component. A good gain and non-directivity are obtained with relatively simple and small-sized antenna pattern.

What is claimed is:

1. A double semi-loop antenna for transmission and reception of a mobile telephone, comprising:

juxtaposed semicircular conductors so as to form a loop on a window glass of a vehicle, any two of said juxtaposed semicircular conductors having at least one common first end connected to each other to provide power feed point means;

L-shaped reactance element conductors, each provided on said window glass and one end of each of said L-shaped reactance element conductors connected to a second end of one of said semicircular juxtaposed conductors; and a ground conductor connected to another end of said L-shaped reactance element conductors.

2. An antenna according to claim 1, further comprising an unbalanced power-feed coaxial feeder wire having a core conductor connected to said feed point means, and an outer conductor connected to said ground conductor.

3. An antenna according to claim 1, wherein said ground conductor is a body of said vehicle.

4. An antenna according to claim 1, wherein said ground conductor is a ground conductive wire arranged on said window glass to connect said semicircular conductors.

5. An antenna according to claim 1, further comprising additional semicircular conductors each provided on said window glass and disposed between each of said second end of said semicircular conductors and said one end of each of said L-shaped reactance element conductors.

6. An antenna according to claim 5, further comprising still further semicircular conductors each provided on said window glass and connected between each of said additional semicircular conductors and said one end of each of said L-shaped reactance element conductors.

7. An antenna according to claim 1, wherein a linear conductive wire having a length about ½ of a predetermined wavelength is provided between said juxtaposed semicircular conductors to connect said first ends, said feed point being arranged at an intermediate point of said linear conductor wire.

* * * * *

UNITED STATES PATENT AND TRADEMARK OFFICE

CERTIFICATE OF CORRECTION

PATENT NO. : 5,285,210

DATED : February 8, 1994

INVENTOR(S) : Gentei SATO et al.

It is certified that error appears in the above-indentified patent and that said Letters Patent is hereby corrected as shown below:

Title page,
In the Abstract, at line 3, insert --,-- after "plane".

At column 1, line 13, delete "a" before the word "use".

At column 2, line 13, delete "," after the number "10".

At column 2, line 38, delete "second" and insert --third--.

Signed and Sealed this

Second Day of July, 1996

Bruce Lehman

*Attest:*

BRUCE LEHMAN

*Attesting Officer*

*Commissioner of Patents and Trademarks*